US008092006B2

(12) United States Patent
Brown et al.

(10) Patent No.: US 8,092,006 B2
(45) Date of Patent: Jan. 10, 2012

(54) HANDHELD PRINTER CONFIGURATION

(75) Inventors: Thomas Daniel Brown, Frankfort, KY (US); Gary Lee Noe, Lexington, KY (US); William Henry Reed, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 1236 days.

(21) Appl. No.: 11/766,807

(22) Filed: Jun. 22, 2007

(65) Prior Publication Data

US 2008/0316290 A1 Dec. 25, 2008

(51) Int. Cl.
*B41J 3/36* (2006.01)

(52) U.S. Cl. ..... 347/109

(58) Field of Classification Search ..... None
See application file for complete search history.

(56) References Cited

U.S. PATENT DOCUMENTS

| | | | |
|---|---|---|---|
| 4,675,700 | A | 6/1987 | Nagira et al. |
| 4,758,106 | A | 7/1988 | Yasui et al. |
| 4,758,849 | A | 7/1988 | Piatt et al. |
| 4,915,027 | A | 4/1990 | Ishibashi et al. |
| 4,933,867 | A | 6/1990 | Ishigaki |
| 4,947,262 | A | 8/1990 | Yajima et al. |
| 4,949,391 | A | 8/1990 | Faulkerson et al. |
| RE33,425 | E | 11/1990 | Nihei |
| 4,999,016 | A | 3/1991 | Suzuki et al. |
| 5,013,895 | A | 5/1991 | Iggulden et al. |
| 5,024,541 | A | 6/1991 | Tsukada et al. |
| 5,028,934 | A | 7/1991 | Kasai et al. |
| 5,052,832 | A | 10/1991 | Akiyama et al. |
| 5,063,451 | A | 11/1991 | Yanagisawa et al. |
| 5,093,675 | A | 3/1992 | Koumura et al. |
| 5,110,226 | A | 5/1992 | Sherman et al. |
| 5,111,216 | A | 5/1992 | Richardson et al. |
| 5,149,980 | A | 9/1992 | Ertel et al. |
| 5,152,624 | A | 10/1992 | Buschmann et al. |
| 5,160,943 | A | 11/1992 | Pettigrew et al. |
| 5,181,521 | A | 1/1993 | Lemelson |
| 5,181,523 | A | 1/1993 | Wendelborn |
| 5,184,907 | A | 2/1993 | Hamada et al. |
| 5,186,558 | A | 2/1993 | Sherman et al. |
| 5,188,464 | A | 2/1993 | Aaron |
| 5,236,265 | A | 8/1993 | Saito et al. |
| 5,240,334 | A | 8/1993 | Epstein et al. |
| 5,262,804 | A | 11/1993 | Petigrew et al. |
| 5,267,800 | A | 12/1993 | Petteruti et al. |
| 5,308,173 | A | 5/1994 | Amano et al. |
| 5,311,208 | A | 5/1994 | Burger et al. |
| 5,312,196 | A | 5/1994 | Hock et al. |
| 5,344,248 | A | 9/1994 | Schoon et al. |
| 5,355,146 | A | 10/1994 | Chiu et al. |
| 5,446,559 | A | 8/1995 | Birk |
| 5,449,238 | A | 9/1995 | Pham et al. |
| 5,462,375 | A * | 10/1995 | Isobe et al. ..... 400/680 |
| 5,475,403 | A | 12/1995 | Havlovick et al. |
| 5,503,483 | A | 4/1996 | Petteruti et al. |
| 5,520,470 | A | 5/1996 | Willett |
| 5,578,813 | A | 11/1996 | Allen et al. |
| 5,593,236 | A | 1/1997 | Bobry |

(Continued)

*Primary Examiner* — Julian Huffman
*Assistant Examiner* — Alexander C Witkowski

(57) ABSTRACT

Methods and apparatus include a handheld printer manipulated by an operator to print an image on a media. An inkjet printhead and two position sensors front one another in a triangular configuration thereby providing a large printable area compared to the prior art. A frame commonly mounts the printhead and sensors and is biased to keep an acceptable paper to printer gap during use. A forward opening door accepts the printhead before printing.

15 Claims, 6 Drawing Sheets

U.S. PATENT DOCUMENTS 5,634,730 A 6/1997 Bobry
5,644,139 A 7/1997 Allen et al.
5,650,820 A 7/1997 Sekine et al.
5,685,651 A 11/1997 Hayman et al.
5,686,720 A 11/1997 Tullis
5,729,008 A 3/1998 Blalock et al.
5,786,804 A 7/1998 Gordon
5,806,993 A 9/1998 Petterutti et al.
5,816,718 A 10/1998 Poole
5,825,044 A 10/1998 Allen et al.
5,829,893 A 11/1998 Kinoshita et al.
5,842,793 A 12/1998 Katayama et al.
5,848,849 A 12/1998 Kishi et al.
5,850,243 A 12/1998 Kinoshita et al.
5,853,251 A 12/1998 Imai
5,862,753 A 1/1999 Dolan et al.
5,887,992 A 3/1999 Yamanashi
5,892,523 A 4/1999 Tanaka et al.
5,927,872 A 7/1999 Yamada
5,953,497 A 9/1999 Kokubo et al.
5,984,455 A 11/1999 Anderson
5,988,900 A 11/1999 Bobry
5,997,193 A 12/1999 Petterutti et al.
6,004,053 A 12/1999 Petteruti et al.
6,005,681 A 12/1999 Pollard
6,010,257 A 1/2000 Petteruti et al.
6,017,112 A 1/2000 Anderson et al.
6,062,686 A 5/2000 Kinoshita et al.
6,076,910 A 6/2000 Anderson
6,092,941 A 7/2000 Imai
6,147,777 A 11/2000 Jung
6,158,907 A 12/2000 Silverbrook et al.
6,164,853 A 12/2000 Foote
6,195,475 B1 2/2001 Beausoleil, Jr. et al.
6,203,221 B1 3/2001 Tomasik et al.
6,246,423 B1 6/2001 Suzuki et al.
6,249,360 B1 6/2001 Pollard et al.
6,259,826 B1 7/2001 Pollard et al.
6,261,011 B1 7/2001 Day et al.
6,270,187 B1 8/2001 Murcia et al.
6,270,271 B1 8/2001 Fujiwara
6,338,555 B1 1/2002 Hirose
6,347,897 B2 2/2002 Huggins et al.
6,357,939 B1 3/2002 Baron
6,367,993 B2 4/2002 Day et al.
6,373,995 B1 4/2002 Moore
6,379,058 B1 4/2002 Petteruti et al.
6,394,674 B2 5/2002 Huggins et al.
6,398,432 B1 6/2002 Day et al.
6,409,401 B1 6/2002 Petteruti et al.
6,433,780 B1 8/2002 Gordon et al.
6,481,905 B2 11/2002 Day et al.
6,499,840 B2 12/2002 Day et al.
6,503,005 B1 1/2003 Cockerill et al.
6,533,476 B2 3/2003 Hamisch, Jr. et al.
6,553,459 B1 4/2003 Silverbrook et al.
6,568,777 B1 5/2003 Anderson et al.
6,572,290 B2 6/2003 McCleave et al.
6,583,895 B1 6/2003 Kuwahara et al.
6,604,874 B2 8/2003 Carriere et al.
6,607,316 B1 8/2003 Petteruti et al.
6,609,844 B1 8/2003 Petteruti et al.
6,623,191 B2 9/2003 Huggins et al.
6,626,597 B2 9/2003 Fujiwara
6,641,313 B2 11/2003 Bobry
6,648,528 B2 11/2003 Hardisty et al.
6,652,090 B2 11/2003 Silverbrook
6,674,543 B2 1/2004 Day et al.
6,688,739 B2 2/2004 Murray
6,736,502 B2 5/2004 Deguchi
6,742,887 B2 6/2004 Ando
2001/0019349 A1 9/2001 Kawakami
2001/0022914 A1 9/2001 Iura et al.
2001/0024586 A1 9/2001 Day et al.
2002/0033871 A1 3/2002 Kaiser
2002/0090241 A1 7/2002 Fujiwara
2002/0127041 A1 9/2002 Huggins et al.
2002/0154186 A1 10/2002 Matsumoto
2002/0186293 A1 12/2002 Ando
2003/0031494 A1 2/2003 Cockerill et al.
2003/0063938 A1 4/2003 Hardisty et al.
2003/0117456 A1 6/2003 Silverbrook et al.
2004/0009024 A1 1/2004 Hardisty et al.
2004/0018035 A1 1/2004 Petteruti et al.
2004/0027414 A1* 2/2004 Boleda et al. ..... 347/37
2004/0061727 A1 4/2004 Kang et al.

* cited by examiner

HANDHELD PRINTER CONFIGURATION

FIELD OF THE INVENTION

Generally, the present invention relates to handheld printers. Particularly, it relates to a configuration of components in handheld printers of the type able to print at random speeds, in random motion patterns and with random housing orientation relative to a media. Printhead positioning, sensor positioning, printer-to-paper spacing, and a frame assembly arranging the printhead and sensor(s) relative to one another, and to paper, are noteworthy features, to name a few.

BACKGROUND OF THE INVENTION

As is known, handheld printers afford mobile convenience to users. Users determine the navigation path of a given swath of printing. In some instances, this includes random movement over a media. In others, it includes back-and-forth movement attempting to simulate a stationary printer. Regardless, printer speed, printer orientation, and the path of motion over the media, to name a few, are irregular and virtually random. To assist with this, optical and/or mechanical sensors are known to sense position on the paper and activate printing whenever the area underneath the printing element matches an imprinted section of a to-be-printed latent image.

With reference to FIG. 6, it has been suggested that an optical sensor 1, 2, be placed both in front and behind a printhead 3. Considering that the optical position sensors are likely to lose positioning if they cross a boundary 4 of the paper 5, the illustrated configuration results in a very large unprintable area, such as in the gap G1 beneath the printhead between a bottommost fluid firing actuator in a column of actuators 6 and the bottom sensor 2. While a smaller printhead would reduce the gap, it would correspondingly reduce an amount of ink in the printhead. Similarly, a smaller but significant gap G2 results at the top between an uppermost fluid firing actuator of the column 6 and the top sensor 1. While the gaps adversely impact design, one advantage does exist in that the sensors 1, 2 are aligned vertically with the column 6, e.g., line V-V, and unprintable edge margins to the sides of the column 6 are limited only by the ability of the operator to complete a swath of printing without overrunning the paper boundary 4.

Nonetheless, a need exists in the art of handheld printers to optimize placement of the printhead and sensors so that the printable area is maximized, while the paper gap is minimized during printing. In that prior handheld printers have had ongoing problems keeping their printhead and/or sensors consistently spaced from the paper, the need must also contemplate maintaining an optimal spacing from the paper. Naturally, any improvements along such lines should further contemplate good engineering practices, such as relative inexpensiveness, stability, flexibility, ease of manufacturing, etc.

SUMMARY OF THE INVENTION

The above-mentioned and other problems become solved by applying the principles and teachings associated with the hereinafter described configuration for handheld printers. Specifically, methods and apparatus contemplate handheld printers manipulated randomly or predictably over a media on which an image is printed. A controller correlates a location of a printhead to the image and causes printing from fluid firing actuators of the printhead. Position sensors provide input to the controller to assist in navigation.

In a representative embodiment the printhead and position sensors front one another in a triangular configuration thereby providing a large printable area compared to the prior art. A frame commonly mounts the printhead and sensors and is biased to keep an acceptable paper-to-printer gap during use. A forward opening door accepts the printhead before printing. The configuration also enables avoidance of ink smearing during use and relative short electric cables between components.

These and other embodiments, aspects, advantages, and features of the present invention will be set forth in the description which follows, and in part will become apparent to those of ordinary skill in the art by reference to the following description of the invention and referenced drawings or by practice of the invention. The aspects, advantages, and features of the invention are realized and attained by means of the instrumentalities, procedures, and combinations particularly pointed out in the appended claims.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE PREFERRED EMBODIMENTS

In the following detailed description of the preferred embodiments, reference is made to the accompanying drawings that form a part hereof, and in which is shown by way of illustration, specific embodiments in which the invention may be practiced. These embodiments are described in sufficient detail to enable those skilled in the art to practice the invention and like numerals represent like details in the various figures. Also, it is to be understood that other embodiments may be utilized and that process, mechanical, electrical, architectural, software and/or other changes may be made without departing from the scope of the present invention. In accordance with the present invention, a configuration of components for a handheld printer is hereafter described.

Figure 1:
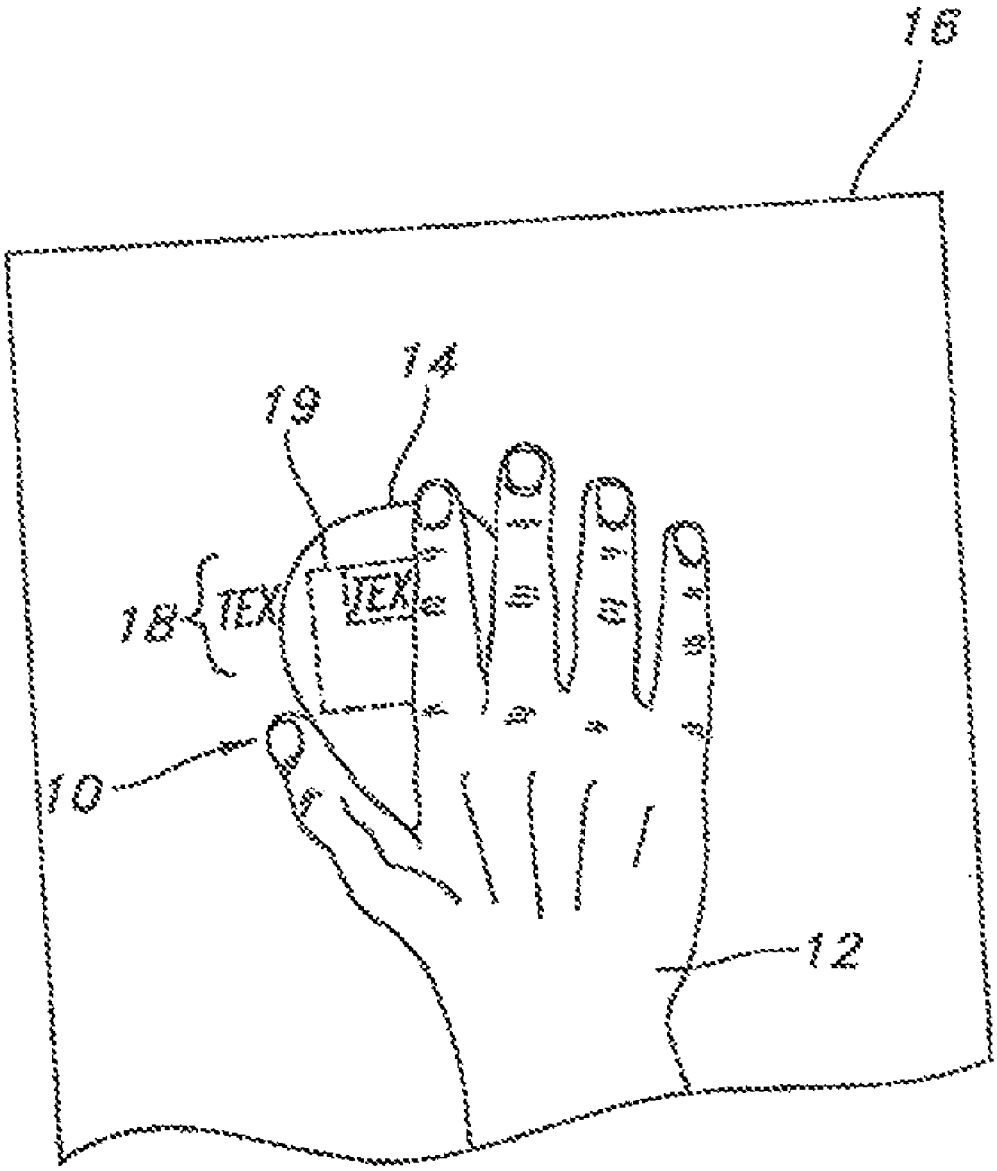
FIG. 1 is a diagrammatic view in accordance with the present invention of a handheld printer during use.

With reference to FIG. 1, a handheld printer of the invention having scheduled printing is given generically as 10. It includes a housing 14 that an operator 12 maneuvers or manipulates back and forth over a media 16 to print an image 18. In various embodiments, the image is text, figures, combinations of text and figures or the like. They are typified in color and/or black and white and formed of ink ejected or expelled from an internal printhead. Also, the printer optionally includes a viewable display panel 19 (dashed line) to assist the operator during printing, such as by showing the image being printed or by providing housekeeping menus, calibration routines, or other user features or options.

Figure 2:
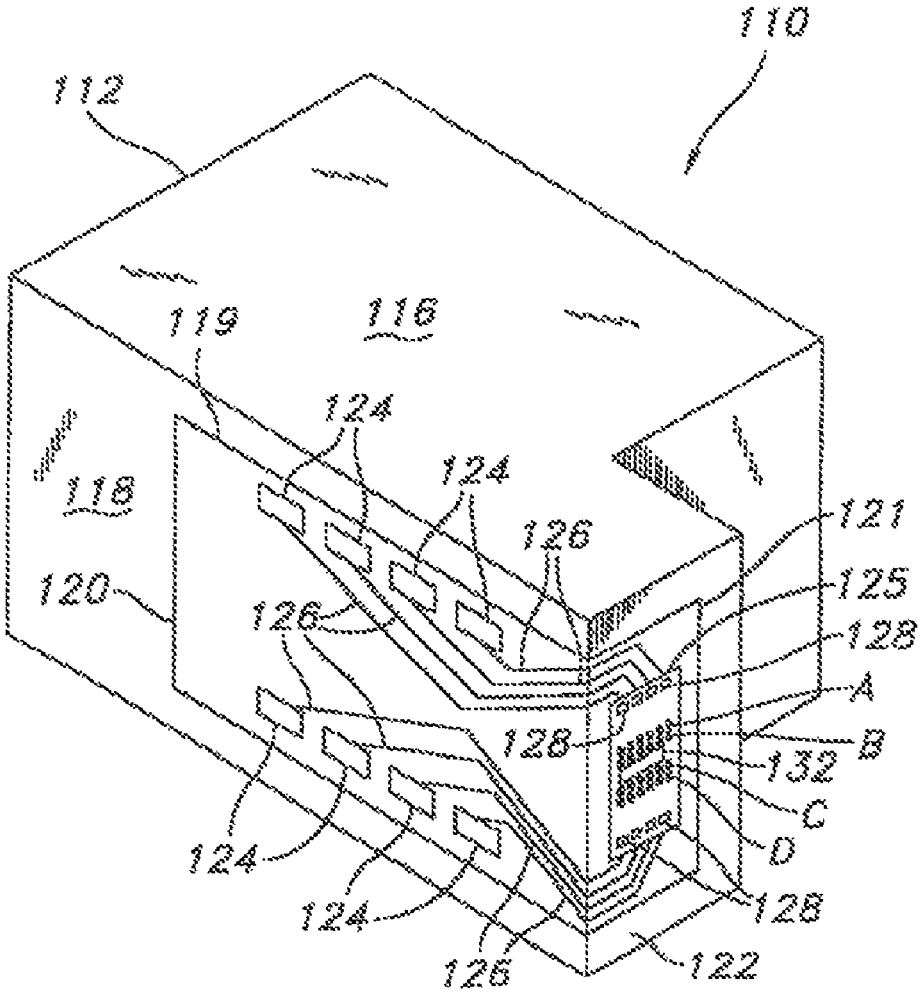
FIG. 2 is a diagrammatic view in accordance with the present invention of a representative inkjet printhead for use in the handheld printer of FIG. 1.

In FIG. 2, a representative inkjet printhead of the printer internal to its housing [14] is shown generally as 110. It includes its own housing 112 having a shape that depends upon the shape of the printer. The housing has at least one internal compartment 116 for holding an initial or refillable supply of ink. In one embodiment, the compartment contemplates a single chamber holding a supply of black, cyan, magenta or yellow ink. In other embodiments, it contemplates multiple chambers containing multiple different colored inks. In one instance, the multiple chambers include singular or plural supplies of cyan, magenta and yellow ink. It also contemplates separability from the housing 112 and/or printhead 110 for ease of refilling, despite being shown locally integrated within the housing.

At one surface 118 of the housing 112 is a portion 119 of a flexible circuit, especially a tape automated bond (TAB) circuit 120. At 121, another portion 121 is adhered to surface 122. Electrically, the TAB circuit 120 supports a plurality of input/output (I/O) connectors 124 for connecting an actuator chip 125 (also known as a heater chip or transducer chip) to the handheld printer during use. Pluralities of electrical conductors 126 exist on the TAB circuit to connect and short the I/O connectors 124 to the input terminals (bond pads 128) of the actuator chip 125 and skilled artisans know various techniques for facilitating this. In an exemplary embodiment, the TAB circuit is a polyimide material and the electrical conductors and connectors are copper or aluminum-copper. For simplicity, FIG. 2 shows eight I/O connectors 124, electrical conductors 126 and bond pads 128 but present day printheads have larger quantities and any number is equally embraced herein. Also, skilled artisans will appreciate that the number of connectors, conductors and bond pads, while shown as equal to one another, may vary unequally in actual embodiments.

At 132, the actuator chip 125 contains at least one ink via that fluidly connects to the ink of the compartment 116. During printhead manufacturing, the actuator chip 125 is attached to the housing with any of a variety of adhesives, epoxies, etc., as is well known in the art. To eject ink, the actuator chip contains columns (column A-column D) of fluid firing actuators, such as thermal heaters. In other actuator chips, the fluid firing actuators embody piezoelectric elements, MEMs devices, and the like. In either, this crowded figure simplifies the actuators as four columns of six dots or darkened circles but in actual practice the actuators might number several dozen, hundred or thousand. Also, vertically adjacent ones of the actuators may or may not have a lateral spacing gap or stagger in between. In general, the actuators indeed have vertical spacing, such as about $1/300^{th}$, $1/600^{th}$, $1/1200^{th}$, or $1/2400^{th}$ of an inch along the longitudinal extent of the via. Further, the individual actuators are typically formed as a series of thin film layers made via growth, deposition, masking, patterning, photolithography and/or etching or other processing steps on a substrate, such as silicon. A nozzle member with pluralities of nozzles or nozzle holes, not shown, is adhered to or fabricated as another thin film layer on the actuator chip such that the nozzle holes generally align with and are positioned above the actuators to eject ink at times pursuant to commands of a controller.

Figure 3:
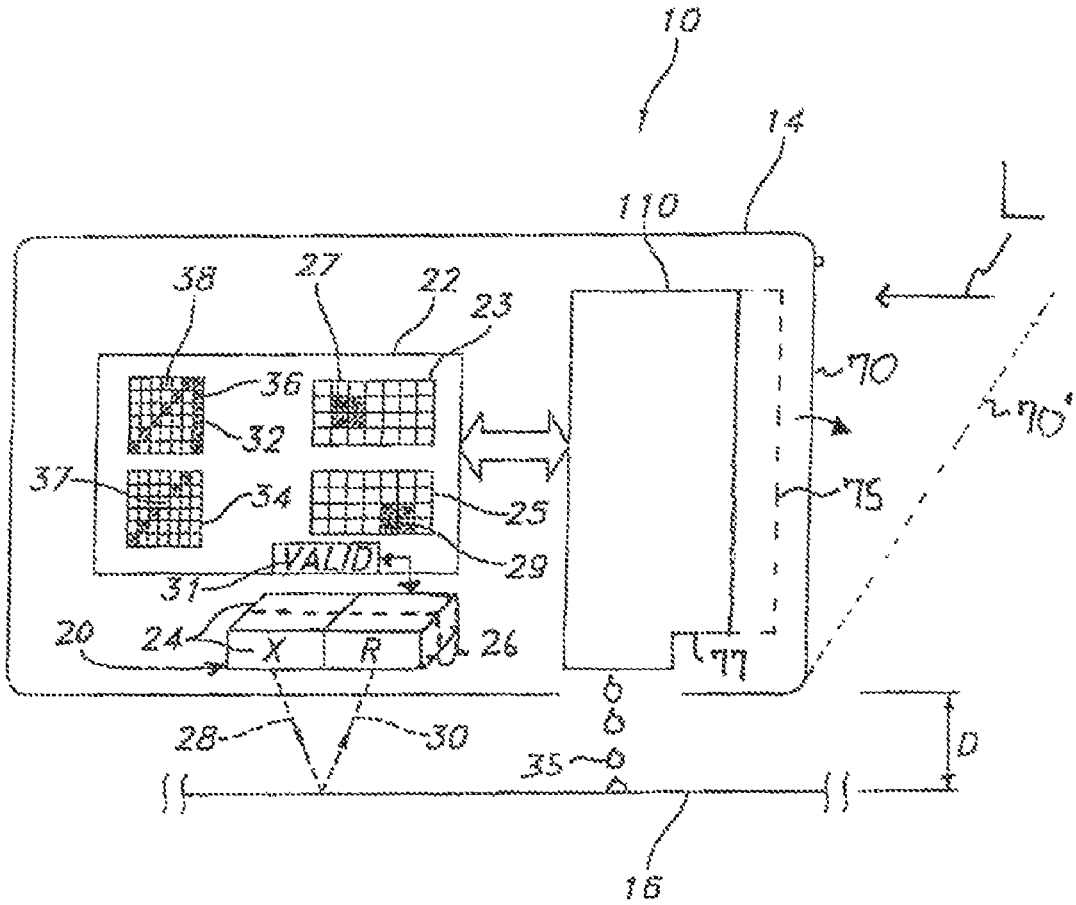
FIG. 3 is a diagrammatic view in accordance with the present invention of a representative configuration of a handheld printer.

With reference to FIG. 3, a greatly exaggerated view of the handheld printer 10 shows a position sensor 20 and a controller 22. Handheld printers typically utilize two position sensors so that angular rotation can be more accurately determined. The position sensors, preferably of the optical type, include a plurality of transmitters 24 and receivers 26 that shine light 28 and capture reflections 30 from the media 16. As is known, media surfaces have random textures (on a micro scale), which then create observable and reflected shadows upon application of light. Eventually, the manipulation of the signals obtained from the sensor regarding the shadows enables an understanding of the position or location of the housing, especially printhead 110, and is made known at the controller regardless of random or predictable movement or speed of the housing 14 by an operator. (Alternatively, a sophisticated x-y mechanical encoder could also provide position sensor information as could structures having energy in other than traditionally optical ranges. That is, optics may include infrared (IR), laser Doppler interferometry, or radio frequency (RF) ranges and technology.)

In a basic sense, the controller 22 is able to discern content of a signal(s) output from the position sensor, and supplied as an input to the controller (bi-directional arrow), and correlate it to the printhead, especially its individual fluid firing actuators to eject ink 35 to print an image. In a detailed sense, the controller is able to compare a signal of the position sensor indicative of a previous location 23, shown as a 4×7 matrix of pixels, to a signal of the position sensor indicative of a current location 25, shown as another 4×7 matrix of pixels, each having four hatched pixels translated from a first position 27 to a second, later position 29. Representatively, the four hatched pixels indicate relatively dark grayscale values on the media 16 that are observed in different orientations over time as a user or operator manipulates the housing 14 to print an image. In turn, the controller is to discern a difference between the previous and current locations and correlate same to the location of the printhead. The controller need also do this quickly and efficiently. In one instance, this means the controller will examine or search the current location for a presence, (such as the four hatched pixels) of the previous location.

In other aspects, the controller contemplates an intake checker 31 between the sensor and controller, or part and parcel of the controller, to assess validity of the signal(s) of the position sensor and to arrange the information thereof such that an actual or proximate relative distance D between the housing and the media can be ascertained. It also contemplates establishment of a threshold inquiry determining whether the housing of the printer is relatively close or far away from the media and whether such is sufficient to conduct further signal processing. Intuitively, operators of the handheld printer have freedom to lift the housing from the media and, if too far away from the media, the signal from the position sensor becomes fairly unusable, or invalid. On the other hand, touching the housing to the media or positioning it within a predetermined close interval renders the signal, and its attendant data, valid. Validity checking also considers application per every instance of a signal received from the sensor or application that occurs randomly, on specified occasions or at predetermined times.

In addition, the controller 22 contemplates a to-be-printed representation of an image 32, especially in bitmap form. It correlates the position of the printhead, especially individual actuators, to the image. It then prints the image with ink 35 on the media 16 according to the image pattern 36 in the pixels 38. A has-been-printed image 34 may also be stored or accessed by the controller to keep track of future printing and to determine whether the image has been printed completely or not. Alternatively, the to-be-printed image 32 is dynamically updated to remove pixels that have been printed so that the has-been printed information 34 is merged with the to-be-printed information. In structure, the controller embodies an ASIC, discrete IC chips, FPGA's, firmware, software, a microprocessor, combinations thereof or the like. The controller further includes a memory to keep track of image data or other information, such as storage and accessibility relative to position sensor signals and their manipulation to compute printer location. Memory also finds utility in general housekeeping matters, such as storage of an operating system, display panel items, print jobs, user features, etc.

Figure 4:
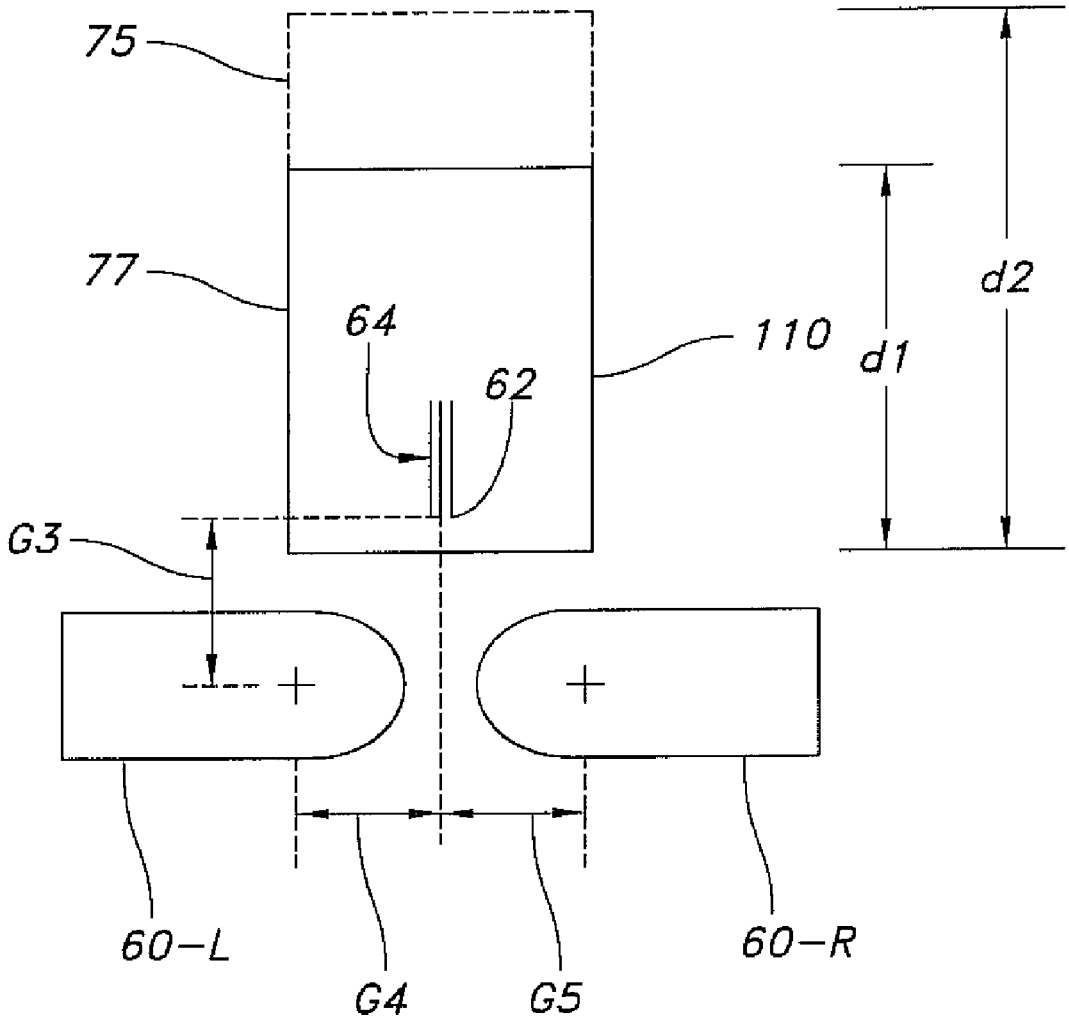
FIG. 4 is top, diagrammatic view in accordance with the present invention of an abbreviated configuration of a handheld printer, including printhead and sensor positioning.
Figure 6:
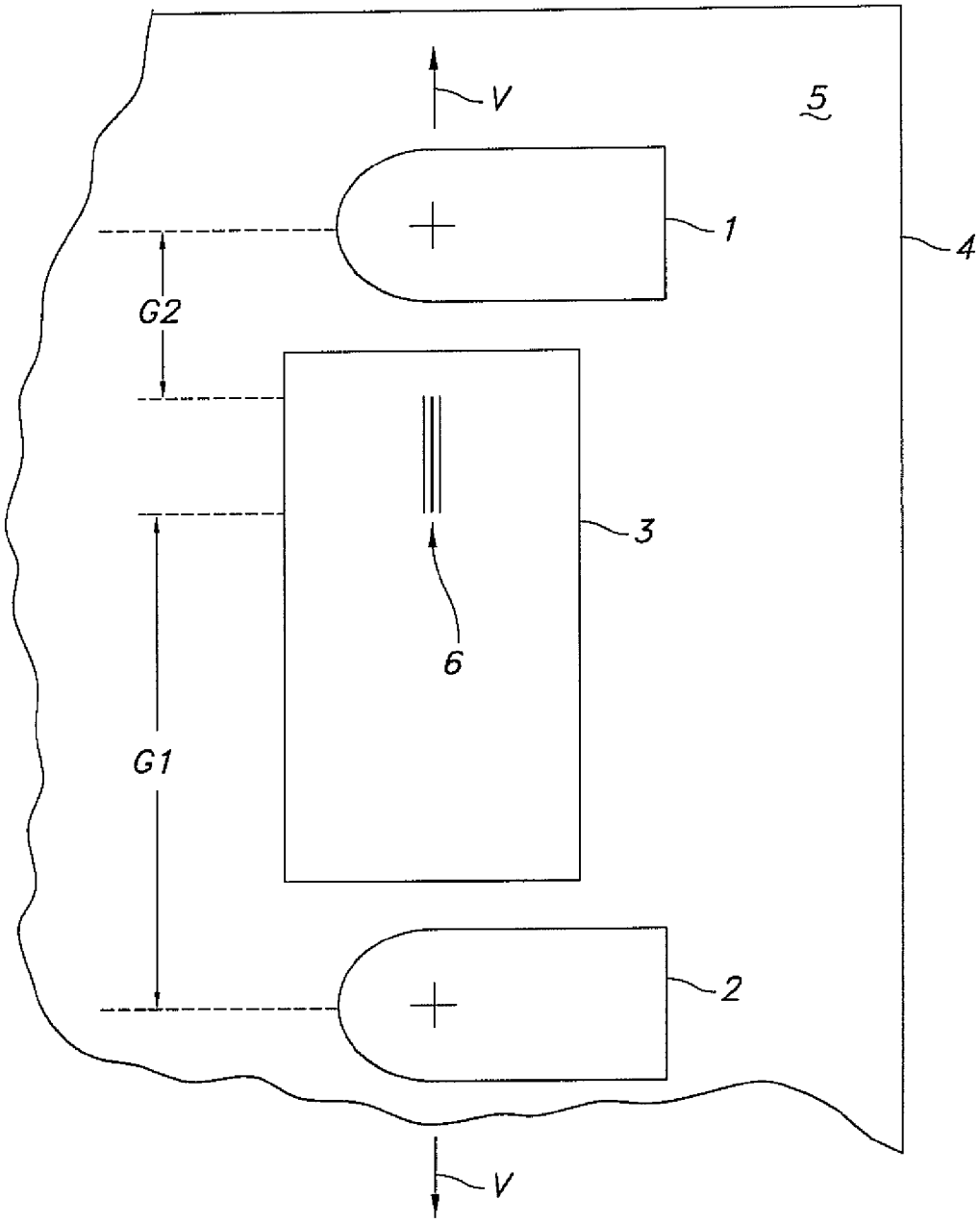
FIG. 6 (PRIOR ART)
FIG. 6 is a top, diagrammatic view in accordance with the prior art of an abbreviated configuration of a handheld printer, including printhead and sensor positioning.

With combined reference to FIG. 4, a simplified planar view of the printhead 110 and sensors 60-L (left, as viewed in the figure) and 60-R (right, as viewed in the figure), (alternatively sensor 20, FIG. 3), reveals a triangular relationship between the components (with vertices of the triangle being the two plus signs (+) of the sensors and a position 62 near a terminal fluid firing actuator in a column of actuators 64). With this configuration, the end of the printhead containing the fluid firing actuators is arranged to front the sensors, thereby altogether eliminating the top gap (of the prior art) and effectively reducing the top printing margin to tolerances associated with use, or about one quarter inch. A bottom gap G3 still remains, but its distance is greatly reduced compared to the prior art. In one embodiment, it is more than halved as evidenced in the exemplary data in the Table, below. While this configuration farther introduces side gaps G4, G5, its distances are dictated by sensor spacing and side, operator tolerances—or about ⅞ inch if the sensors are about one inch apart. As can be seen in the Table, the triangular configuration produces a printable area of 15 square inches (73.125 $in^2$-58.125 $in^2$) more than the prior art shown in FIG. 6, for example.

TABLE

| Configuration | Top margin | Bottom margin | Side margin | Print Area* |
|---|---|---|---|---|
| Linear (prior art, e.g., FIG. 6) | 1.0" | 2.5" | 0.38" | 7.75" × 7.5" (58.125 $in^2$) |
| Triangular (e.g., FIG. 4) | 0.25" | 1.0" | 0.88" | 7.5" × 9.75" (73.125 $in^2$) |

In that the Print Area* of the Table was calculated based on a standard 8.5 ×11 inch letter-sized paper, other print area improvments are achieved with other sized media as skilled artisans will appreciate. Also, skilled artisans will be able to contemplate other size advances by even more tightly controlling tolerances, such as by positioning components closer, shrinking component size, or other.

Another advantage lies in that the printhead 110 fronts the entirety of the sensors. No longer are sensors on a front and back side of the printhead, thereby no attendant electrical contacts or other structures dictate a loading direction into the housing of the printer. A door 70 (FIG. 3) can then be opened by users toward a front end of the housing 14 to a position 70' (shown in phantom) and the printhead can be inserted in a loading direction L toward the sensors, as opposed to the top to bottom loading fashion as in the prior art. A lengthwise distance d1 or d2 of the printhead body may be increased or decreased significantly without affecting the defined configuration and the resulting printable area of the printer. A standard-sized printhead is shown in dashed lines 75 while a compact-sized printhead is shown in solid lines 77.

Figure 5B:
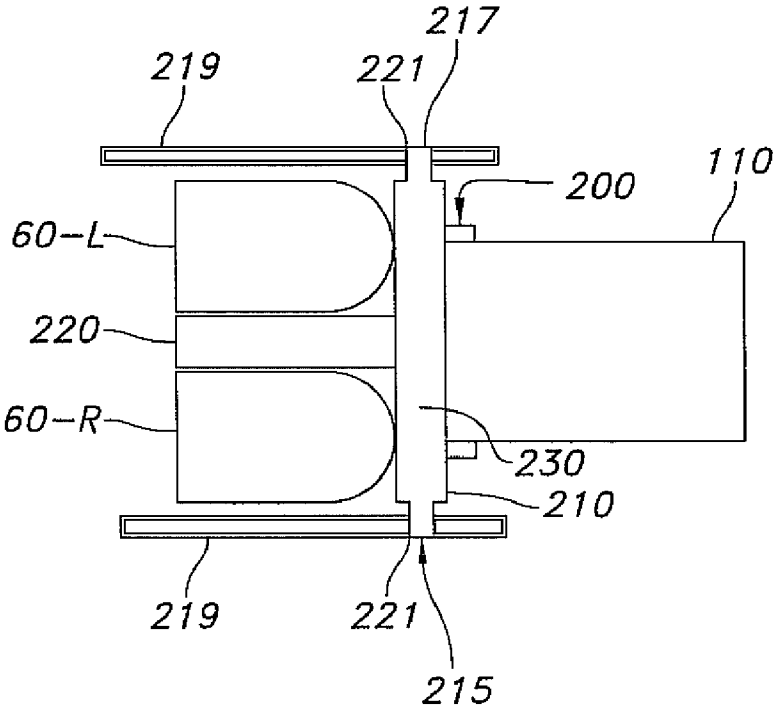
FIGS. 5A and 5B are side and top diagrammatic views in accordance with the present invention, respectively, of an abbreviated configuration of a handheld printer, including a frame assembly for a printhead and sensors.
Figure 5A:
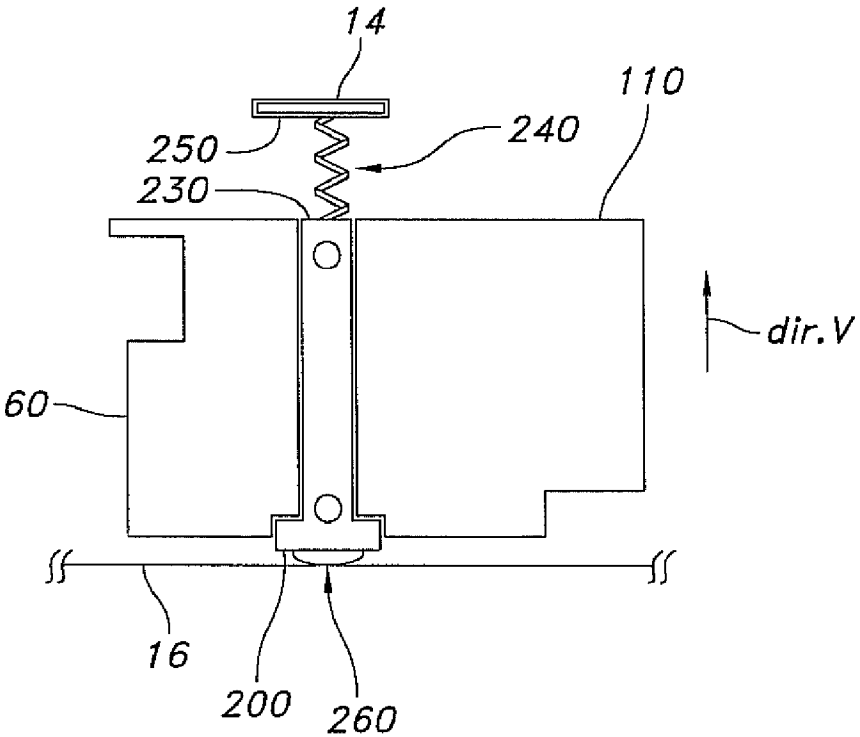

With reference to FIGS. 5A and 5B, a common structural frame for mounting the sensors and the printhead in the printer is given as element 200. It typifies a T-frame shape, in FIG. 5B, defined by orthogonal frame members 210 and 220. Naturally, the frame members can be a single structure formed together daring manufacturing or separate members attached to one another. In either, it is fabricated with precision tolerances at reference datum points where the sensors and printhead mount—this providing accurate placement and facilitating calibration and alignment. It also includes a "floating" arrangement within the printer housing embodied by biasing a top 230 of the frame 200 against the media 16 and allowing pins 215, 217 of the frame to "bounce" or move vertically (dir. V) within slots 221 of rails 219. Intuitively, the rails may be structures separate from the housing or integral with the housing such that the slots are formed directly in the housing wall surfaces. A spring 240 fits between a wall 250 of the housing 14 and, as a bottom surface 260 of the frame rides against a surface of the media, or other surfaces on which it prints, a proper relative distance D (FIG. 3) between the printhead/sensors and the media can be maintained. As imagined, this represents a significant advantage because printing with handheld printers is often performed under rushed and suboptimal conditions where the printing surface is less than desktop flat.

In other embodiments, shapes are anticipated other than the T-frame whereby both sides of the position sensors are considered to be reference surfaces so that sensors can be attached to either side of the T-frame. More likely, only one side is referenced, and the T-frame might become shaped more like a letter "E." Regardless, the frame should be dimensionally stable and manufactured to precise tolerances. Possible materials include aluminum or other metal that might be die cast and/or machined to final dimensions; a fiber-filled polymer molded to shape; or a machinable plastic like polyacetal homopolymer. In all designs, it is anticipated that the weight of the frame will be lighter than frames adopted in prior art so as to bounce freely. Further, so long as the dimensional relationship of the sensors and printhead is fixed after calibration, the frame can move somewhat within the printer housing during use because the location of the ink jets remains fixed relative to the position determined by data from the sensors. This means that sudden changes in print direction or angle by the operator can be damped and so reduce the likelihood of navigation failure.

Certain other advantages contemplate assuring that the media or paper is adequately supported. In one implementation, a switch or sensor can detect vertical motion of the frame when the printer is pressed on the paper, and a signal can be used to block or prevent printing whenever the printer is not in contact with well-supported paper, e.g., part of the intake checker 31, FIG. 3. In this manner, printing will be discontinued if the printer is lifted off the paper, or too far from the paper, thereby minimizing risk that ink might be sprayed on people, their clothing, or other nearby objects. Servicing of the sensors or printhead on the frame is made easy because they are isolated from the rest of the printer components and can be easily removed or serviced via door 70 without disturbing the circuit cards, or other components.

Still other advantages of the invention over the prior art should be readily apparent. For example, the present invention minimizes the possibility of ink smearing. The triangular printhead/sensor configuration allows the printhead to be cantilevered over the paper, unlike the prior art linear configuration, e.g., FIG. 6, requiring a top sensor 1 to pass over areas of the paper already printed with ink. While smearing is still possible with the present design if the operator returns to repair an imprinted area missed in the initial printing, but the ink will have had more time to dry than with the linear configuration. Also, when the printer is not in use, a protective cover for the sensors and printhead can be made smaller and better integrated into the printer housing because the sensors and printhead are closer together when compared to prior art. For this same reason, cables carrying high-frequency signals from the sensors to the circuit board, and back to the printhead, are also able to be minimized—resulting in better electromagnetic compatibility, less, weight, and easier assembly.

One of ordinary skill in the art will recognize that additional embodiments are also possible without departing from the teachings of the present invention. This detailed description, and particularly the specific details of the exemplary embodiments disclosed herein, is given primarily for clarity of understanding, and no unnecessary limitations are to be imported, for modifications will become obvious to those skilled in the art upon reading this disclosure and may be made without departing from the spirit or scope of the invention. Relatively apparent modifications, of course, include combining the various features of one or more figures with the features of one or more of other figures.

What is claimed:

1. A handheld printer to be manipulated back and forth by an operator over a media during use to print an image on the media, comprising:

a hand maneuverable housing for the operator;

an inkjet printhead in the housing to print the image by ejecting ink from a plurality of fluid firing actuators, the printhead having a front and back; and two position sensors to provide a location of the housing during use, the two position sensors being either closer to the front of the printhead than the back of the printhead, or closer to the back of the printhead than the front of the printhead, further including a terminal fluid firing actuator forming a triangular configuration in combination with the two position sensors.

2. The handheld printer of claim 1, further including a frame for commonly mounting both the printhead and the two position sensors.

3. The handheld printer of claim 2, further including a biasing member to bias the frame in a direction toward the media during use.

4. The handheld printer of claim 3, wherein the biasing member is a spring that is fit between a wall of the housing and a top of the frame.

5. The handheld printer of claim 2, further including a plurality of pins on the frame loosely carried in a plurality of vertical slots so the pins may vertically move during use.

6. The handheld printer of claim 2, wherein the frame is T-shaped in a planar view defined by orthogonal members.

7. The handheld printer of claim 1, further including a door to be opened toward a front end of the housing to enable load of the printhead from the front end before printing.

8. In a handheld printer having a housing to be manipulated back and forth by an operator over a media during use to print an image on the media, a method of maintaining an acceptable gap between the media and the housing, comprising:

providing a printhead in a frame in the housing, the frame having a bottom surface;

biasing the frame toward the media to keep the surface in substantial contact with the media during printing;

assessing whether the gap between the media and the housing is valid;

wherein the providing the printhead in the frame further includes providing two position sensors in the frame being either closer to the front of the printhead than the back of the printhead, or closer to the back of the printhead than the front of the printhead;

wherein the providing the printhead in the frame further includes forming a triangular configuration with two position sensors in the frame and a terminal fluid firing actuator of the printhead.

9. The method of claim 8, wherein the biasing includes fitting a spring between a wall of the housing a top of the frame to push the frame in a downward direction toward the media.

10. The method of claim 9, further including allowing the frame to vertically move in a vertical slot of the housing.

11. A handheld printer to be manipulated back and forth by an operator over a media during use to print an image on the media, comprising:

a hand maneuverable housing for the operator;

an inkjet printhead in the housing to print the image by ejecting ink from a plurality of fluid firing actuators, the printhead having a front and back;

a controller communicating with each said fluid firing actuators to eject ink or not to print the image; and two position sensors communicating with the controller to provide a location of the housing during use, the two position sensors being either closer to the front of the printhead than the back of the printhead, or closer to the back of the printhead than the front of the printhead, further including a terminal fluid firing actuator of the plurality of fluid firing elements forming a triangular configuration in a plane in combination with the two position sensors.

12. The handheld printer of claim 11, further including a frame for commonly mounting both the printhead and the two position sensors.

13. The handheld printer of claim 12, further including a spring that is fit between a wall and a top of the frame to bias the frame toward the media during use.

14. The handheld printer of claim 11, further including a plurality of pins on the frame loosely carried in a plurality of vertical slots so the pins may vertically move during use.

15. The handheld printer of claim 11, further including a door to be opened toward a front end of the housing to enable loading of the printhead from the front end before printing.

* * * * *